US007770997B2

(12) United States Patent
Richard et al.

(10) Patent No.: US 7,770,997 B2
(45) Date of Patent: Aug. 10, 2010

(54) PRINTHEAD DIE WARMING

(75) Inventors: Wayne Richard, San Diego, CA (US); John M. Watanabe, Oceanside, CA (US); Jacint Humet, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 1262 days.

(21) Appl. No.: 10/951,378

(22) Filed: Sep. 27, 2004

(65) Prior Publication Data

US 2006/0066655 A1 Mar. 30, 2006

(51) Int. Cl.
*B41J 29/38* (2006.01)
*B41J 2/21* (2006.01)

(52) U.S. Cl. ..... 347/17; 347/14; 347/43

(58) Field of Classification Search ..... 347/12, 347/15, 14, 17, 19, 43
See application file for complete search history.

(56) References Cited

U.S. PATENT DOCUMENTS 5,036,337 A 7/1991 Rezanka
5,714,989 A 2/1998 Wade
5,726,690 A 3/1998 Bohorquez et al.
6,042,211 A * 3/2000 Hudson et al. ..... 347/15
6,422,677 B1 7/2002 Deshpande et al.
6,431,679 B1 * 8/2002 Li et al. ..... 347/19
6,456,311 B1 * 9/2002 Harush et al. ..... 347/116
6,648,442 B2 11/2003 Bauer
6,698,858 B1 * 3/2004 Askeland et al. ..... 347/12
6,726,301 B2 4/2004 Walker
2003/0081034 A1 * 5/2003 Bauer ..... 347/17
2003/0234828 A1 12/2003 Walker
2004/0090480 A1 * 5/2004 Teshikawara et al. ..... 347/15
2004/0119765 A1 6/2004 Fujimori et al.
2005/0231549 A1 * 10/2005 Askeland et al. ..... 347/40

* cited by examiner

*Primary Examiner*—Matthew Luu
*Assistant Examiner*—Jannelle M Lebron

(57) ABSTRACT

A method for printing with a plurality of dies. A plurality of dies is provided, with each die having a plurality of drop generators that are configured to eject drops of a same colored fluid. The drops from each die have a corresponding nominal drop weight at a reference temperature of the die. At least one of the dies is warmed to a corresponding elevated temperature higher than the reference temperature in order to substantially equalize the nominal drop weights of all of the dies.

55 Claims, 13 Drawing Sheets

PRINTHEAD DIE WARMING

BACKGROUND OF THE INVENTION

Printing devices are widely used for producing text, graphics, and photographic images on a print medium. Such printing devices include printers which connect to computers as peripheral devices, and stand-alone systems which can copy physical items such as documents or photographs, or print information that is contained on electronic storage devices such as memory cards for a digital camera. Some of these printing systems use inkjet printing technology, in which either or both of a printhead and a print medium are moved relative to each other, while drops of color fluid are controllably ejected from the printhead in order to produce the printed output on the medium.

As these printing devices have gained popularity, there has been a corresponding market demand for faster and higher-quality print output. One way to produce faster print output is to use a larger printhead so as to be able to print a greater portion of the medium at a time, and thus produce the printed medium faster. However, larger printheads may exhibit characteristics which undesirably degrade the quality of the print output.

For these and other reasons, there is a need for the present invention.

BRIEF DESCRIPTION OF THE DRAWINGS

The features of the present invention and the manner of attaining them, and the invention itself, will be best understood by reference to the following detailed description of embodiments of the invention, taken in conjunction with the accompanying drawings, wherein.

DESCRIPTION OF THE PREFERRED EMBODIMENT

Figure 1:
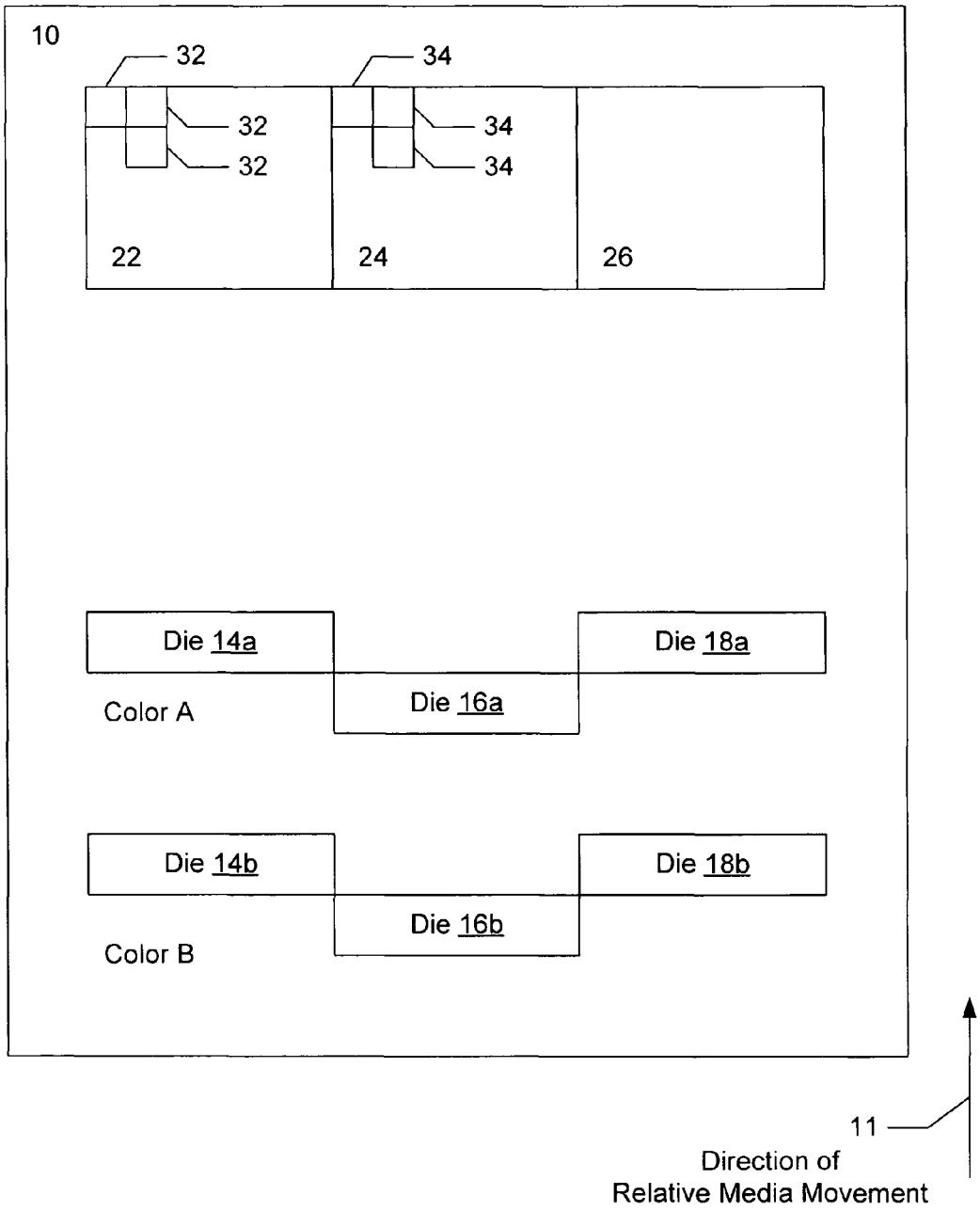
FIG. 1 is a schematic representation of printing produced by a printhead having multiple dies according to an embodiment of the present invention.

Referring now to the drawings, there is illustrated an embodiment of a multi-die printing system constructed in accordance with the present invention which provides for equalizing the nominal drop weights of drops of a particular colored fluid emitted from certain ones of the dies so as to result in high image quality printing. One or more multiple-die printheads are used in a print mechanism, with drop generators in each of the dies capable of controllably emitting fluid drops. The fluid drops emitted by a particular die have a nominal drop weight at a reference temperature. The nominal drop weight may vary from die to die. A heating arrangement is thermally coupled to at least some of the various dies. A controller in the system determines from the emitted drops amounts of warming that, when applied to some corresponding ones of the various dies, will substantially equalize the nominal drop weights of all of the dies. The controller also applies the various amounts of warming to the various dies to perform the equalization.

The printing system typically deposits the emitted drops onto a print medium. The print medium may be any type of suitable sheet or roll material, such as paper, card stock, cloth or other fabric, transparencies, mylar, and the like, but for convenience the illustrated embodiments may be considered as using paper as the print medium. The printing system of the present invention may be embodied as different devices, such as inkjet printers, plotters, portable printing units, copiers, cameras, video printers, laser printers, facsimile machines, and multifunction or "all-in-one" devices (e.g. a combination of at least two of a printer, scanner, copier, and fax), to name a few.

As defined herein and in the appended claims, "drop weight" shall be broadly understood to mean the weight of a drop, usually of a uniformly colored fluid, such as an ink, that is emitted from a drop generator of a printhead die. Drop weight is often expressed in nanograms (ng). Drop weight is also directly proportional to drop volume, which is often expressed in picoliters (pL), through the formula: Drop Weight=Density×Drop Volume. Some fluids such as ink may have a density substantially equal to 1, in which case the drop weight in nanograms will be substantially equal to the drop volume in picoliters. Further, the "nominal drop weight" of a printhead die shall be broadly understood to mean a typical, characteristic, or average drop weight of the drops emitted from a die, taking into account randomized variations in drop weight that may occur between individual drop generators of the die.

Also as defined herein and in the appended claims, the "reference temperature" of the die shall be broadly understood to mean the temperature of the die during operation in the printing system, but without the application of any additional warming by the printing system for purposes of drop weight equalization among dies. It is recognized that some amount of heat may be generated as part of the drop emission process as, for example, in a thermal inkjet printhead die. It is also recognized that some amount of warming may be applied to one or more of the printhead dies in order to ensure that the nominal drop weights from that die are consistent over time and usage. Both the heat produced by the drop emission process, and the warming applied to ensure consistent drop weights over time, are encompassed by the reference temperature, and are not to be considered as additional warming for purposes of drop weight equalization among dies.

Furthermore, terms of orientation and relative position (such as "top", "bottom," "side,", "horizontal", "vertical", and the like) are not intended to require a particular orientation of the present invention or of any element or assembly of the present invention, and are used only for convenience of illustration and description.

Considering now in greater detail the arrangement of, and printed output produced by, a multi-die printing system, and with further reference to FIG. 1, one exemplary embodiment includes three printhead dies 14*a*,16*a*, 18*a* for emitting fluid drops of color A, and three printhead dies 14*b*, 16*b*, 1 8*b* for emitting fluid drops of color B. Regions 22,24,26 represent areas on the print medium onto which fluid drops have been emitted. The printhead dies 14,16,18, the print medium 10, or both are moveable relative to each other in the direction of relative media movement 11 such that drop generators in dies 14*a*,14*b* can emit fluid drops onto region 22, drop generators in dies 16*a*,16*b* can emit fluid drops onto region 24, and drop generators in dies 18*a*, 18*b* can emit fluid drops onto region 26 during a single linear movement (i.e. a "single pass"). For purposes of illustration, it is intended that regions 22,24 will have the same, uniform appearance when printed. As will be discussed subsequently in greater detail with reference to FIGS. 2A-2B and 3A-3B, region 22 is made up of a number of subregions 32, and region 24 is made up of a number of subregions 34 (only two subregions in each region are illustrated for clarity). In some embodiments a subregion 32,34 may represent a pixel, while in other embodiments a subregion 32,34 may represent a cluster of pixels. The term "pixel", as defined herein and in the appended claims, shall be broadly understood to mean an elemental unit of the data being printed on the medium 10. In addition, while three dies for each color are illustrated in FIG. 1, other embodiments may contain two or more dies for each color.

In some embodiments, two or more dies for a particular color may be contained in a multi-die printhead module. For example, dies 14*a*,16*a*,18*a* could be contained in a multi-die printhead module, while dies 14*b*,16*b*,18*b* could be contained in another multi-die module. In other embodiments, two or more dies for different colors may be disposed in a multi-die printhead module. For example, a multi-die module could contain dies 14*a*,14*b*,16*a*,16*b*,18*a*,18*b*.

In other embodiments, a die may emit drops of more than one color. For example, a single die may emit fluid drops of both color A and color B, and a multi-die printhead module may contain two or more of such dies. Furthermore, while the printhead dies for a given color are illustrated as arranged in a staggered orientation, the printheads may be disposed relative to each other according to alternative layouts.

With regard to the following discussions of FIGS. 2A-2B and 3A-3B, it is to be understood that the particular size, shape, number, and arrangement of the fluid drops and subregions is merely exemplary, not to scale, and chosen for illustrative purposes.

Figure 2A:
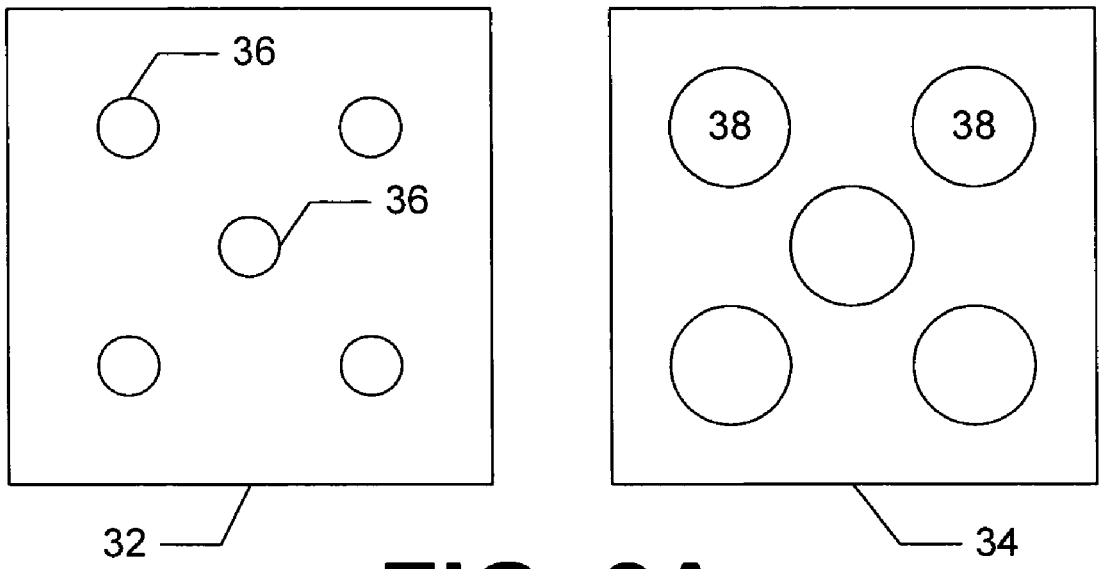
FIG. 2A is an enlarged schematic representation of two portions of the printing of FIG. 1 according to an embodiment of the present invention, in which each portion is produced by a different die and with a same colored fluid, and in which each die emits drops of a different drop weight.
Figure 2B:
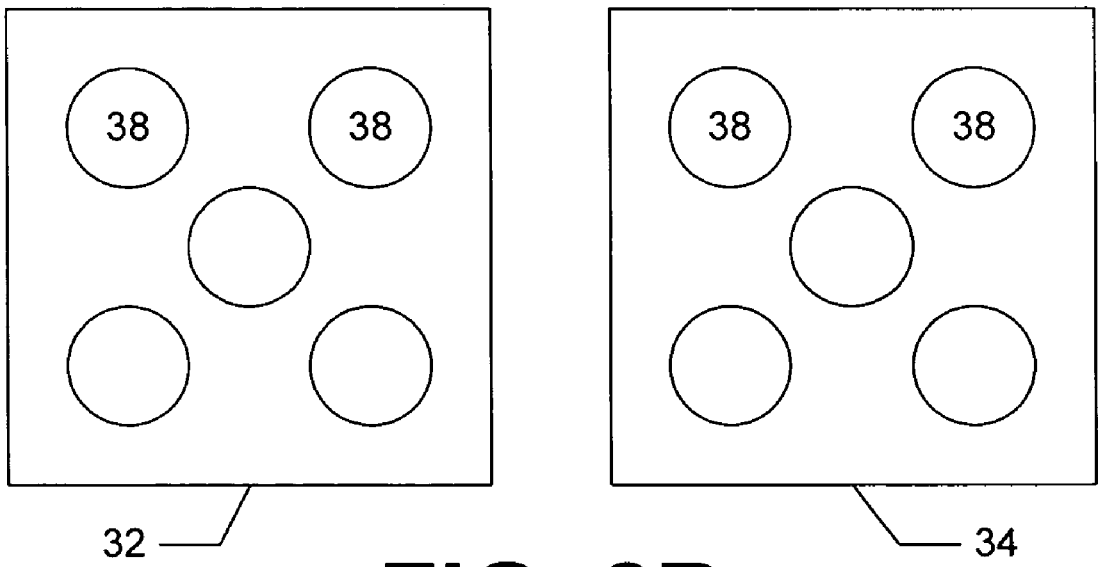
FIG. 2B is an enlarged schematic representation of two portions of the printing of FIG. 1 according to an embodiment of the present invention, in which each portion is produced by a different die and with a same colored fluid, and in which each die emits drops of the same drop weight after drop weight equalization.

Considering now in greater detail the emission of fluid drops of a single same color onto subregions 32,34 from dies 14*a*,16*a*, and with reference to FIG. 2A, in one embodiment die 14*a* emits drops 36 having a relatively smaller nominal drop weight at a reference temperature, while die 16*a* emits drops 38 having a relatively larger nominal drop weight at the reference temperature. While subregions 32,34 are intended to represent the same print data and thus have the same appearance, the smaller drops from die 14*a* will cover a smaller percentage of the area of subregion 32 while the larger drops from die 16*a* will cover a larger percentage of the area of subregion 34. Therefore, subregion 32 will have more unprinted white space than subregion 34. Consequently, since this same effect occurs throughout regions 22,24, region 22 will appear lighter in color to the human eye than region 24, which creates a visual discontinuity that degrades the image quality of the printed medium 10.

However, in some drop generators, such as thermal inkjet drop generators that will be discussed subsequently with reference to FIG. 7, the drop weight can be increased by warming the die such that the drop generators are operated at an elevated temperature that is somewhat higher than the reference temperature. For a given type of die, the increase in drop weight for a corresponding increase in temperature can be calculated or determined experimentally. Then by determining the difference in drop weights between drops 36 and drops 38, an amount of warming to be applied to die 14*a* in order to increase the drop weight of the drops emitted from die 14*a* so that, as best understood with reference to FIG. 2B, both die 14*a* and die 16*a* will emit drops 38 having substantially the same, larger drop weight. When both subregions 32,34 are printed with drops having the same drop weight, they will both have the same amount of unprinted white space, and therefore the visual appearance of regions 22,24 will appear uniform to the human eye and thus will exhibit a high image quality. In addition to regions 22,24 having uniform lightness or darkness, regions 22,24 will also be perceived by the human eye to have substantially the same graininess because the individual drops 36,38 are of substantially the same drop weight.

Furthermore, it should be noted that if die 18*a* is also used to print region 26, and if die 18*a* emits drops that have yet a different nominal drop weight than either die 14*a* or die 16*a*, the two dies having the lower nominal drop weights could each have the appropriate amount of warming applied to them. When operated at the corresponding elevated temperatures, the nominal drop weights of the warmed dies will be increased so as to substantially equalize the nominal drop weights of all three dies 14*a*, 16*a*, 18*a*. A different amount of warming can be applied to each warmed die as required for equalization.

Figure 3A:
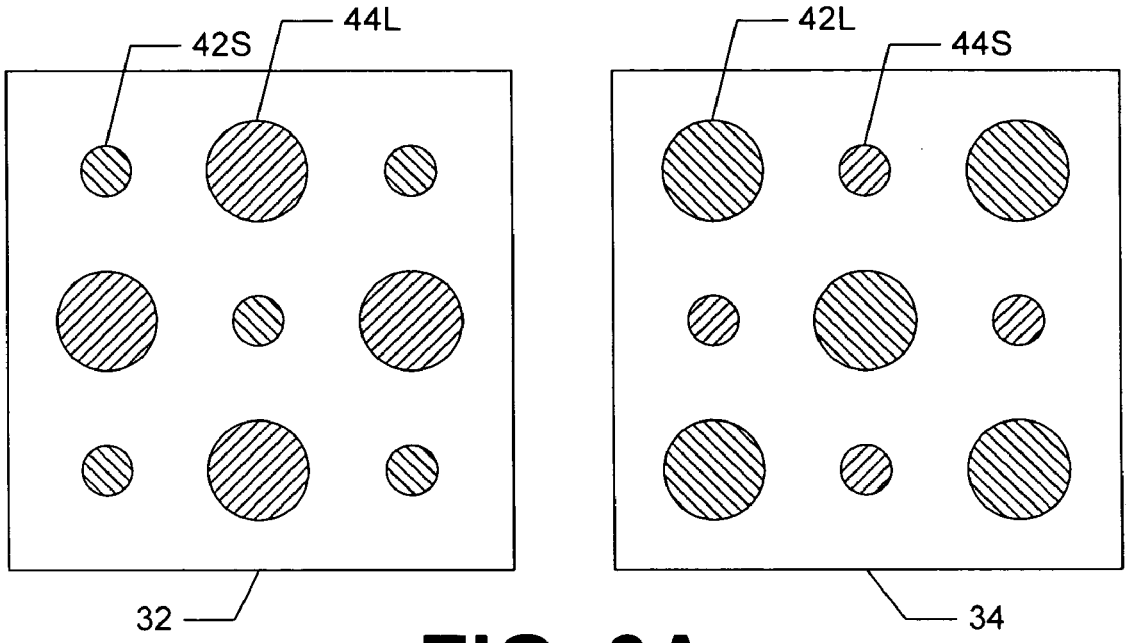
FIG. 3A is an enlarged schematic representation of two portions of the printing of FIG. 1 according to an embodiment of the present invention, in which each portion is produced by a different first die of a first colored fluid and a different second die of a second colored fluid, and in which each first die emits drops of a different drop weight and each second die emits drops of a different drop weight.

Considering now in greater detail the emission of fluid drops of at least two different colors onto each of subregions 32,34, and with reference to FIG. 3A, in one embodiment die 14*a* emits drops 42S of color A having a relatively smaller nominal drop weight at a reference temperature onto subregion 32, and die 14*b* emits drops 44L of color B having a relatively larger nominal drop weight at a reference temperature onto subregion 32. While for illustrative purposes the drops 42S,44L are shown as non-overlapping, in some embodiments the drops may overlap on medium 10. The relatively greater proportion of color B and the relatively lesser proportion of color A in subregion 32 may result in region 22 exhibiting a first color characteristic, such as a first hue, saturation or lightness, to the observer. Conversely, die 16*a* emits drops 42L of color A having a relatively larger nominal drop weight at a reference temperature onto subregion 34, and die 16*b* emits drops 44S of color B having a relatively smaller nominal drop weight at a reference temperature onto subregion 34, resulting in region 24 exhibiting a different second color characteristic, such as a second hue, saturation, or lightness, to the observer. The difference in the color characteristics between regions 22,24 creates a visual discontinuity that degrades the image quality of the printed medium 10

Figure 3B:
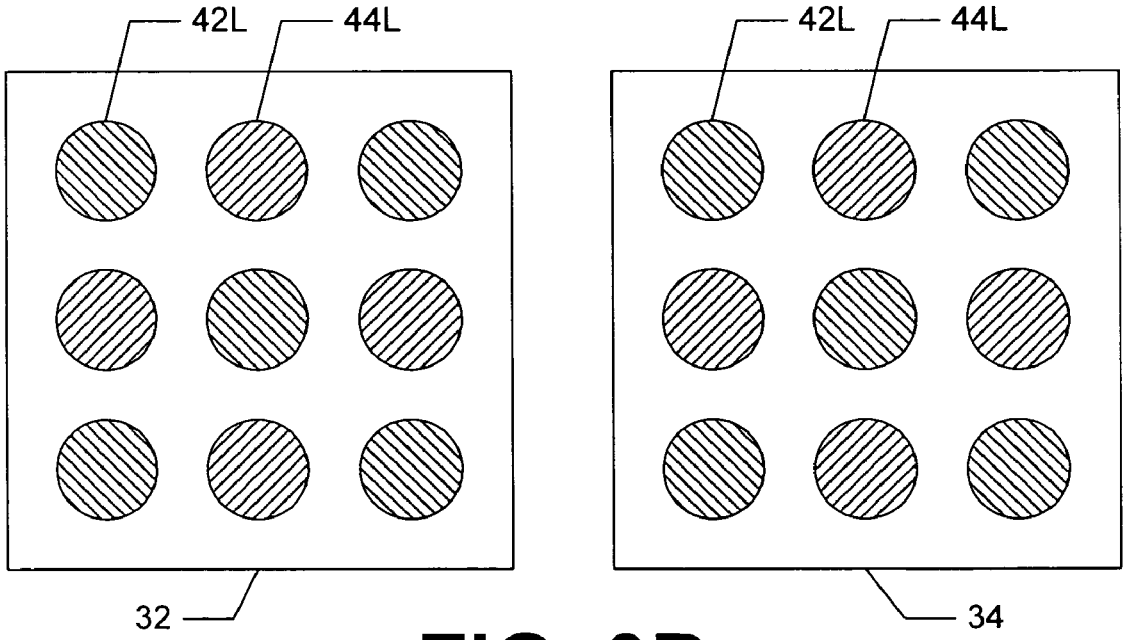
FIG. 3B is an enlarged schematic representation of two portions of the printing of FIG. 1 according to an embodiment of the present invention, in which each portion is produced by a different die of a first colored fluid and a different die of a second colored fluid, and in which each first die emits drops of the same drop weight after drop weight equalization and each second die emits drops of the same drop weight after drop weight equalization.

However, by substantially equalizing the nominal drop weights for the dies 14*a*, 16*a* of color A, and substantially equalizing the nominal drop weights for the dies 14*b*,16*b* of color B, as best understood with reference to FIG. 3B, the difference in color characteristics can be minimized and the image quality improved. For each color, nominal drop weights may be substantially equalized as discussed heretofore with reference to FIGS. 2A-2B. It should be noted that the equalized drop weights for the dies 14*a*, 16*a* of color A do not necessarily have to match the equalized drop weights for the dies 14*b*,16*b* of color B. Typically it is the difference in color characteristics that occurs between region 22 and region 24 that is the most visually perceptible.

Figure 4:
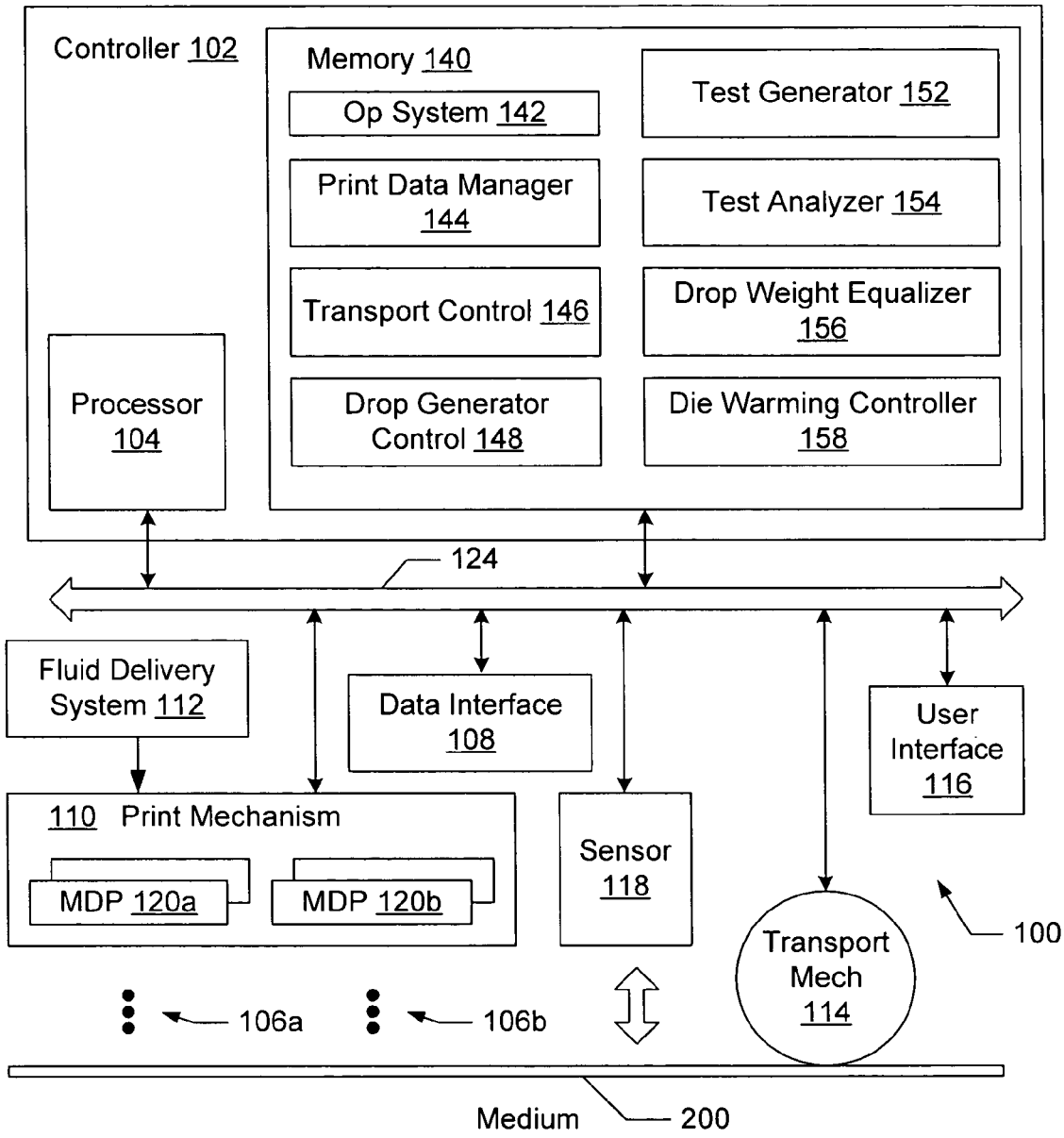
FIG. 4 is a block diagram according to an embodiment of the present invention of a printing system having equalized drop weight printhead dies.

Another embodiment of the present invention, as best understood with reference to FIG. 4, is a printing system 100. Printing system 100 includes a print mechanism 110. At least one printhead having a plurality of dies, such as multi-die printheads 120*a*,120*b*, may be installed in print mechanism 110. As will be described subsequently in greater detail with reference to FIGS. 6-7, each die has a plurality of drop generators that are configured to emit drops of a same colored fluid. Each printhead 120*a* installed in print mechanism 110 emits drops 106*a* of one colored fluid, while each printhead 120*b* installed in print mechanism 110 emits drops 106*b* of a different colored fluid. One embodiment includes a sufficient number of printheads to emit drops of four colored fluids, typically black, magenta, cyan, and yellow inks. Different embodiments may have a sufficient number of printheads to emit drops of six, eight, nine, or other numbers of colored fluids. The various colored fluids are provided to print mechanism 110 from fluid delivery system 112 which contains supplies of each of the various colored fluids.

The printing system 100 also includes a transport mechanism 114. As known to those having ordinary skill in the art, transport mechanism 114 controllably moves a print medium 200, the print mechanism 110, or both so as to position the print mechanism 110 adjacent different portions of the medium 200 such that drops of the colored fluids are controllably emitted from the print mechanism 110 onto the desired portions of the medium 200. Transport mechanism 114 may include, for example, one or more rollers (not shown) to move and position the print medium 200, and a movable carriage (not shown) for holding and positioning the printheads 120*a*, 120*b*.

The emission of fluid drops from the printheads 120*a*,120*b* in the print mechanism 110, and the movements of the medium 200 and/or the print mechanism 110 performed by the transport mechanism 114, are governed by a controller 102. The controller 102 also determines, from emitted fluid drops, the amounts of warming (if any) that, when applied to corresponding ones of the dies in the various printheads 120*a*, 120*b*, will substantially equalize the nominal drop weights of all of the dies. Different amounts of warming may be associated with different ones of the dies. As will be discussed subsequently in greater detail with reference to FIGS. 6-7, the controller 102 also controls a heating arrangement in the printhead 120*a*,120*b* that applies the amount of warming to the various dies.

In one embodiment, controller 102 includes a processor 104 and a memory 140. The processor 104 may represent multiple processors, and the memory 140 may represent multiple memories that operate in parallel. In such a case, the local interface 124 may be an appropriate network that facilitates communication between any two of the multiple processors, between any processor and any one of the memories, or between any two of the memories etc. The processor 102 may be electrical, molecular, or optical in nature.

The memory 140 is defined herein as both volatile and nonvolatile memory and data storage components. Volatile components are those that do not retain data values upon loss of power. Nonvolatile components are those that retain data upon a loss of power. Thus, the memory 140 may comprise, for example, random access memory (RAM), read-only memory (ROM), hard disk drives, floppy disks accessed via an associated floppy disk drive, compact discs accessed via a compact disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

In one embodiment, the controller 102 includes a number of software components that are stored in a computer-readable medium, such as the memory 140, and are executable by the processor 104. In this respect, the term "executable" means a program file that is in a form that can be directly (e.g. machine code) or indirectly (e.g. source code that is to be compiled) performed by the processor 104. An executable program may be stored in any portion or component of the memory 140. Each software component comprises logic that implements the functionality of that component. In this regard, the controller 102 includes an operating system 142 that controls the allocation and usage of resources in the printing system 100 such as the memory 140, processing time of the processor 104, and access to the functions provided by the other components that are connected to the local interface 124. In this manner, the operating system 219 serves as a foundation on which applications that provide the functionality of the printing system 100 can be built and executed.

A print data manager component 144 receives print data representative of the text, graphics, or images to be printed via data interface 108, and interacts based on the print data with a transport control component 146 and a drop generator control component 148. The transport control component 146 governs the previously-described operations of the transport mechanism 114, while the drop generator control component 148 governs the previously-described operations of the print mechanism.

A test generator component 152 emits drops of a same colored fluid from each of the plurality of dies. Typically the test generator 152 operates each of the dies at the reference temperature in order to allow the differences in drop weight, and thus the amount of warming required to equalize the drop weights, to be determined. However, in order to confirm that the determined amounts of warming do indeed equalize the drop weights, the test generator 152 may subsequently operate certain ones of the dies at their corresponding elevated temperatures. In one embodiment, the drops are emitted adjacent to a sensor 118 which is configured to sense a nominal drop weight of the fluid in the emitted drops. In another embodiment, the drops emitted by test generator 152 generate a test plot on the print medium 200.

Figure 5:
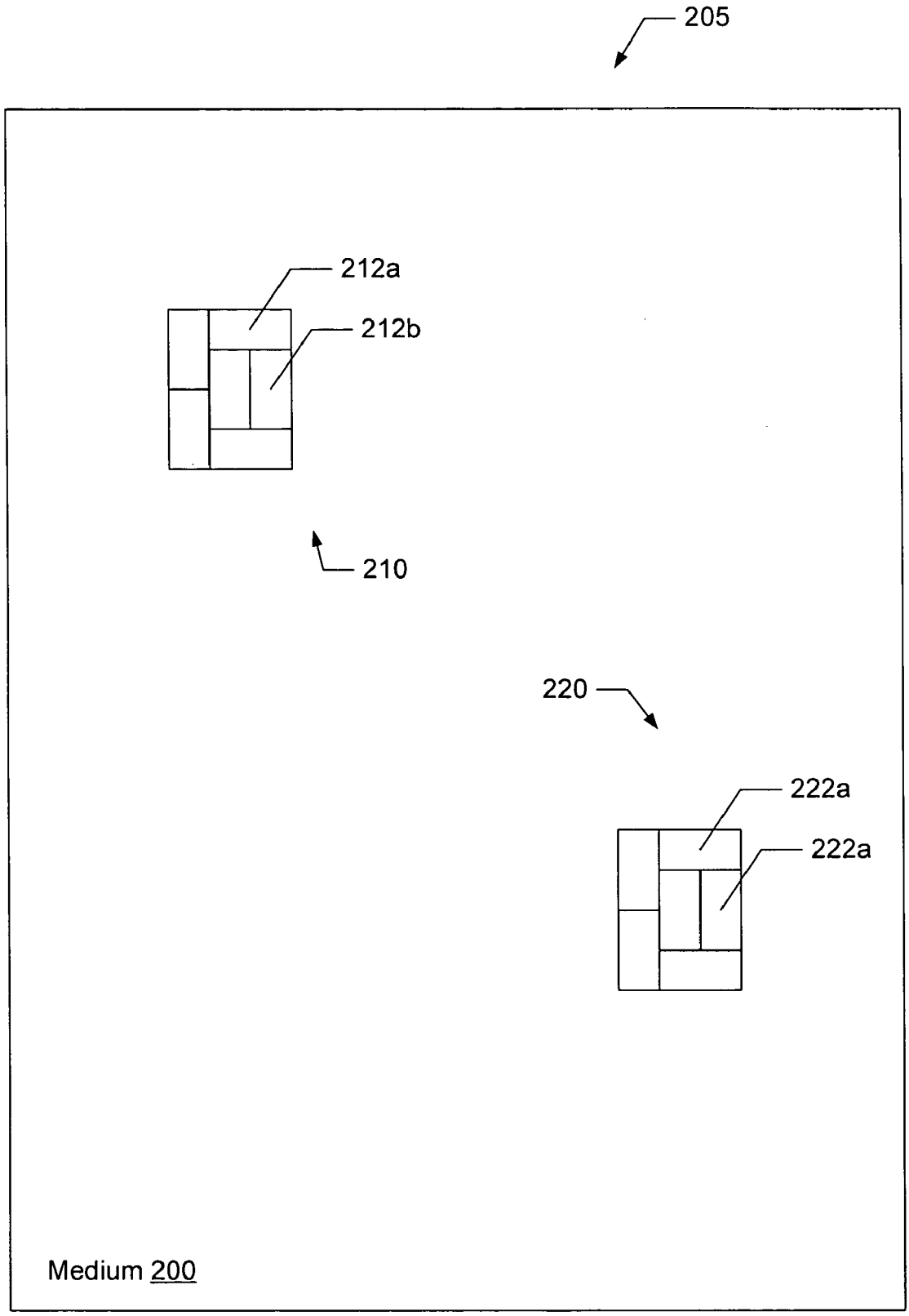
FIG. 5 is a schematic representation according to an embodiment of the present invention of an exemplary printed medium produced by the printing system of FIG. 4.

One exemplary test plot, such as test plot 205 which is best understood with reference to FIG. 5, includes a plurality of printed patches, such as patches 212*a*,212*b*. Each printed patch is produced by the colored fluid drops emitted from one of the dies; for example, patch 212*a* may be formed by the drops emitted from die 14*a* (FIG. 1), while patch 212*b* may be formed by the drops emitted from die 16*a* (FIG. 1). Each printed patch further has an optical characteristic representative of the nominal drop weight of the corresponding one of the plurality of dies. In some embodiments, the characteristic may be an optical density, a darkness, or other optical characteristics.

In some embodiments, the printed patches may be arranged to form a cluster, such as cluster 210, in a particular region of the medium 200, so as to collectively occupy a relatively compact area of the medium 200. All the patches in a cluster are typically printed with the same colored fluid. By clustering the printed patches, the adverse effects on the optical characteristics of the printed patches caused by variations in the print medium 200, can be mitigated. For example, variations in the print medium 200 may include one portion of the medium 200 being darker than another portion, which could be misinterpreted instead as an increased darkness of the printed patch. Since such print medium variations often vary gradually across the dimensions of the medium 200, clustering the printed patches in the same portion of the medium 200 typically avoids such problems. While the exemplary printed patches on medium 200 are all illustrated as rectangular, they are not limited to a rectangular shape, nor are they limited to all having the identical shape or dimensions.

In some embodiments, the test generator 152 may generate more than one cluster, such as clusters 210,220, on the print medium 200. Some of the clusters may be generated using the same colored fluid, while others of the clusters may be generated using different colored fluids. For a particular colored fluid, each printed patch in cluster 220 may be generated with the same die, and using the same number of drops, as its corresponding patch in cluster 210, so as to exhibit the same characteristic, such as the same darkness or optical density, as the corresponding patch in cluster 210. Alternatively, each patch in cluster 220 may be generated using a different number of drops from its corresponding patch in cluster 210, so as to exhibit a different characteristic, such as a different darkness or optical density, from the corresponding patch in cluster 210.

At least one cluster is typically generated for each colored fluid used in the printing system 100. In one embodiment, for example, the patches in cluster 210 may be generated by the dies that emit fluid drops having a cyan color, while the patches in cluster 220 may be generated by other dies that emit fluid drops having a magenta color.

With regard to the selection of the proper number of drops emitted for a patch, in some embodiments the patches may be printed by emitting a sufficient number of drops such that the intended optical density of the printed patches will correlate to a peak sensitivity of an optical density sensor, such as a sensor 118. By operating the sensor at its peak sensitivity, a maximum change in the sensor output signal will be obtained for a given change in the optical density of the printed patches.

Continuing now with printing system 100, and with continued reference to FIG. 4, controller 102 includes a test analyzer component 154 which ascertains the characteristic representative of the nominal drop weight of each printhead die from the drops emitted by that die as controlled by the test generator 152. In one embodiment, the test analyzer 154 directly senses the nominal drop weight from the drops emitted adjacent to the sensor 118. For example, each 1 millivolt (mV) increase in the signal output of sensor 118 may correspond to a N nanogram increase in drop weight.

In another embodiment, the test analyzer 154 optically analyzes each of the printed patches in clusters 210,220 on medium 200, and determines or ascertains an optical characteristic of each printed patch. In some embodiments, the characteristic is the optical density of each patch. The optical density may be determined based on the darkness of each patch. The characteristic may have an absolute measure, or may be defined relative to other patches. The test analyzer 154 typically determines the optical density of each printed patch based on measurement signals received from the sensor 118. For example, a 1 mV increase in signal output may correspond to an X percent increase in optical density, which in turn may correspond to a Y nanogram increase in drop weight. Where the test plot 205 includes multiple clusters 210,220, the optical densities determined or ascertained for the corresponding dies in the first cluster and the second cluster may be averaged.

In yet another embodiment, test analyzer 154 receives user input, via user interface 116, regarding the optical density or other optical characteristic of the printed patches from the operator of the printing system 100. In this embodiment, for example, the printing system 100 may print a number of different patches on the medium 200 for each die, and the operator may indicate which patches for each die appear to have the same darkness.

Controller 102 also includes a drop weight equalizer component 156 that determines, from the characteristics ascertained by the test analyzer 154, the individual amount of warming, if any, that should be applied to each die in order to substantially equalize the nominal drop weights of all of the dies that emit drops of a particular color fluid. These dies can be disposed in the same printhead or in different printheads.

For a particular printhead die architecture or type, the relationship between drop weight and die temperature may be predefined or predeterminable. For example, within a certain temperature range, each 1 degree of increase in temperature of a die may produce an 0.2 nanogram increase in drop weight. Therefore, referring back to FIG. 1, assume for purposes of an illustrative example that at the reference temperature die 14*a* has a drop weight of 5.8 ng, die 16*a* has a drop weight of 6.0 ng, and die 18*a* has a drop weight of 5.9 ng. Drop weight equalizer 156 would therefore determine that die 14*a* receive 1.0 degrees of warming, and die 18*a* receive 0.5 degrees of warming. Die 16*a*, which had the largest drop weight, would not be warmed. Application of the warming to dies 14*a*, 18*a* would substantially equalize the drop weights of all three dies 14*a*,16*a*,18*a* at 6.0 ng. For some dies, drop weight equalization may be most effective when the difference in drop weights between dies is less than about 5.4%, or when the maximum amount of warming to be applied is less than about 3 degrees C. For other dies, drop weight equalization may be most effective when the difference in drop weights between dies is less than about 15%, or when the maximum amount of warming to be applied is less than about 8 degrees C. An excessive amount of warming may cause reliability problems with some dies, with the risk of occurrence of such problems increasing as a higher amount of warming is applied.

Controller 102 also includes a die warming controller component 158 that applies each of the amounts of warming determined by the drop weight equalizer component 156 to the corresponding die so as to substantially equalize the nominal drop weights of all of the dies of a particular color. How the heat is applied to dies 120*a*,120*b* will be discussed subsequently in greater detail with reference to FIGS. 6 and 7.

In some embodiments, the operation of the test generator 152 and test analyzer 154 may be repeated after the warming has been applied in order to verify that the drop weights have been substantially equalized. If necessary, the amounts of warming can be adjusted from the previously determined values in order to better equalize the drop weights.

Although the printer system 100 described heretofore a number of software components, as an alternative the components may also be embodied in dedicated hardware, or in a combination of software with general purpose and dedicated hardware. If embodied in dedicated hardware, the components can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, programmable gate arrays (PGA), field programmable gate arrays (FPGA), or other components, etc.

Figure 6A:
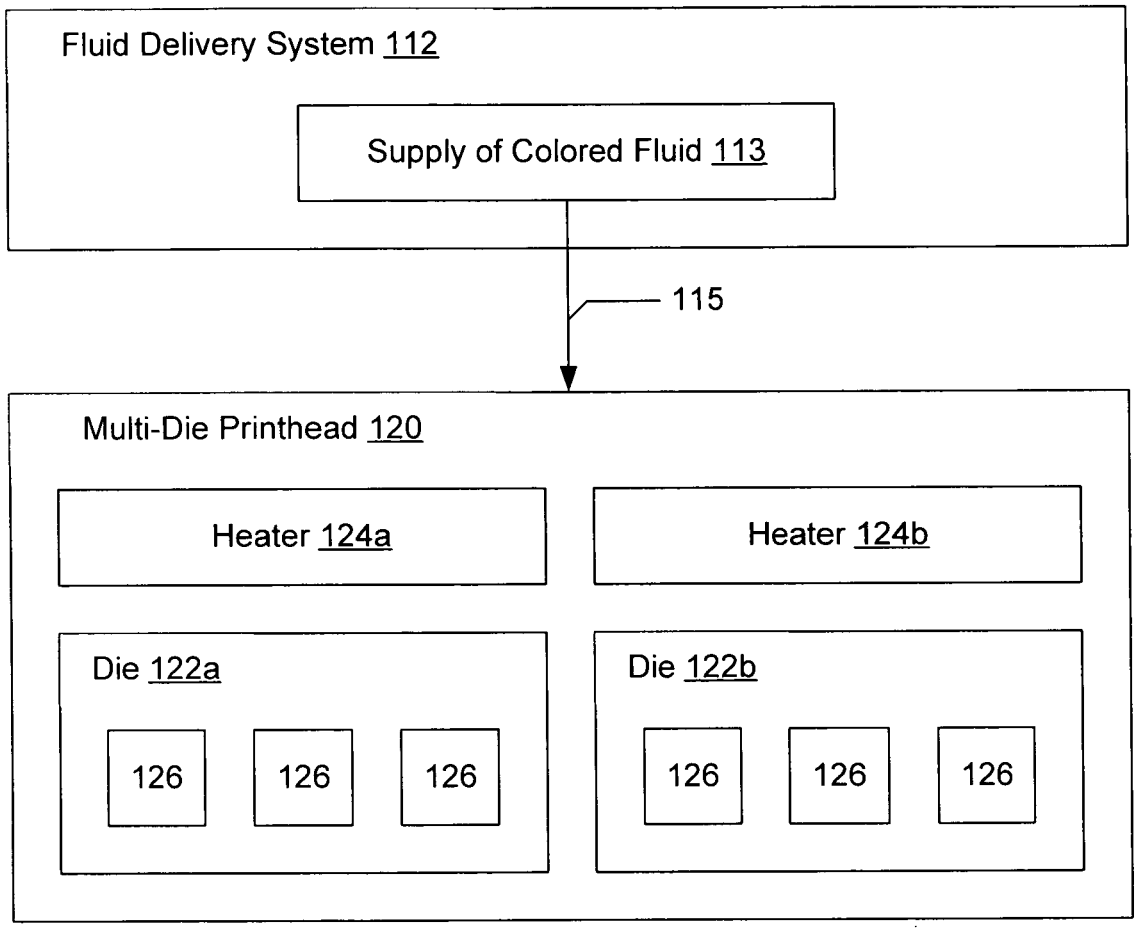
FIG. 6A is a block diagram according to an embodiment of the present invention of one multi-die printhead usable with the printing system of FIG. 4.

Considering now in greater detail one embodiment of a multi-die printhead 120, and with reference to FIG. 6A, the multi-die printhead 120 includes a plurality of printhead dies, such as dies 122*a*,122*b*. Each die includes a plurality of drop generators 126. The drop generators 126 for each die are typically arranged in one or more linear arrays, such as two linear arrays. The spacing between adjacent drop generators 126 in an array may be $1/300^{th}$ inch, $1/600^{th}$ inch, or other distances. The axes of the arrays are typically parallel to each other in a plane on a surface of the die. The arrays may be in-line with each other, or may be offset from each other in a direction along the axes.

One embodiment of drop generator 126 is a thermal inkjet drop generator, which will be discussed subsequently in greater detail with reference to FIG. 7. In one embodiment, fluid delivery system 112 includes a supply of a colored fluid 113, which is provided to multi-die printhead 120 via conduit 115. Both dies 122*a*,122*b* receive the colored fluid 113, drops of which are controllably emitted from drop generators 126.

In some embodiments of the multi-die printhead 120 a heater, such as heaters 124*a*,124*b*, is in thermal communication with each corresponding die, such as dies 122*a*,122*b*. The heaters are controllable to apply the appropriate amount of warming to the corresponding die. While in the illustrated embodiment heaters 124*a*,124*b* are separate from the dies 122*a*,122*b*, in other embodiments heaters 124*a*,124*b* may be part of dies 112*a*,122*b* respectively. In one embodiment the heater is provided by drive electronics 168 (FIG. 7) associated with one or more of the drop generators 126. A trickle current may be supplied to some elements of the drive electronics 168 to produce heat, such as by resistive heating, which provides the warming.

Figure 6B:
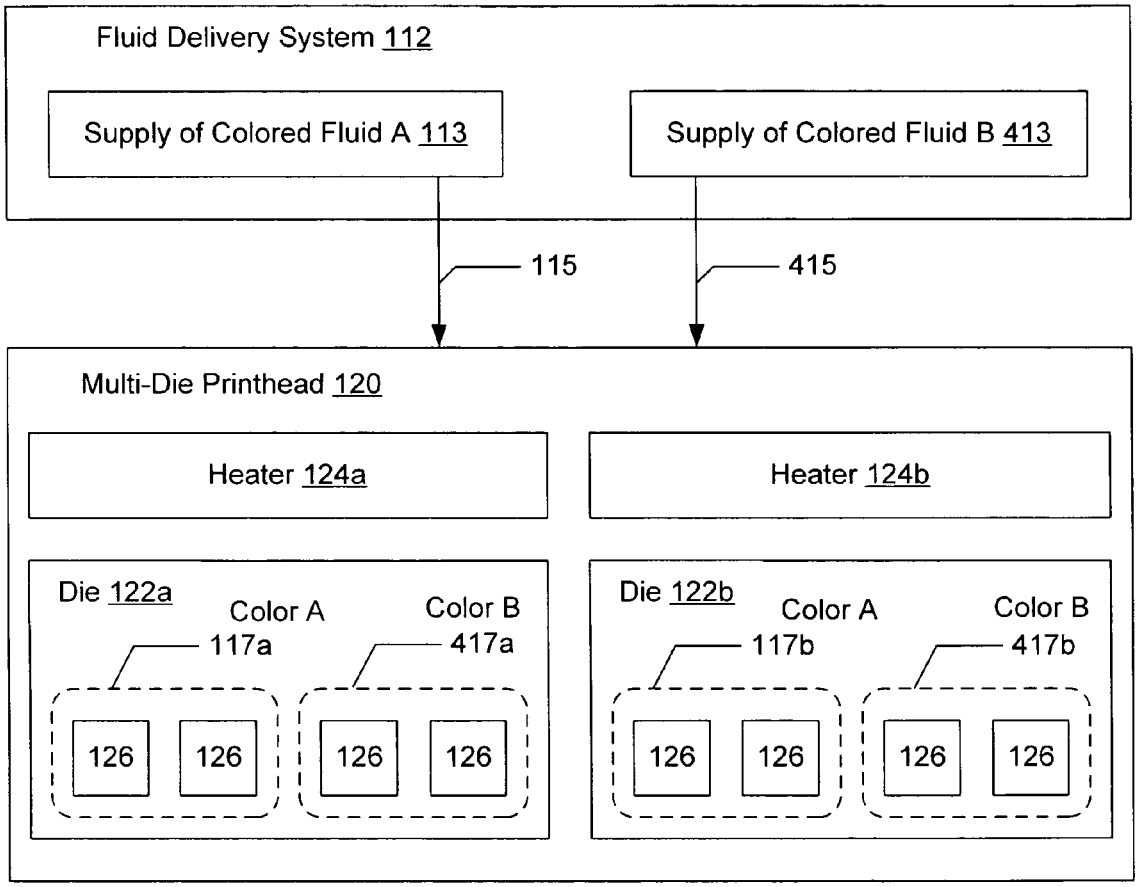
FIG. 6B is a block diagram according to an embodiment of the present invention of another multi-die printhead usable with the printing system of FIG. 4.

Considering now in greater detail another embodiment of a multi-die printhead 120, and with reference to FIG. 6B, the multi-die printhead 120 includes a plurality of printhead dies, such as dies 122*a*,122*b*. Dies 122*a*,122*b* include a plurality of drop generators 126, which are grouped into two or more drop generator sets. For example, die 122*a* has two sets 117*a*,417*a* of drop generators 126, while die 122*b* has two sets 117*b*, 417*b* of drop generators 126. Fluid delivery system 112 may provide a different colored fluid for each drop generator set in a die. For example, an embodiment of fluid delivery system 112 for dies 122*a*, 122*b* each having two drop generator sets includes two supplies of colored fluid. Supply 113 provides fluid of color A, which is provided to multi-die printhead 120 via conduit 115. Supply 413 provides fluid of color B, which is provided to multi-die printhead 120 via conduit 415. Both dies 122*a*,122*b* receive the colored fluids 113,413. Fluid drops of color A are controllably emitted from the drop generators 126 of set 117*a* of die 122*a* and set 117*b* of die 122*b*. Fluid drops of color B are controllably emitted from the drop generators 126 of set 417*a* of die 122*a* and set 417*b* of die 122*b*.

In some embodiments, the drop generators 126 of set 117*a* may be arranged in a first linear array, while the drop generators 126 of set 117*b* may be arranged in a second linear array parallel to and in-line with the first array such that drop generators 126 of sets 117*a*, 117*b* can emit drops of color A and color B onto same ones of the subregions 32 (FIG. 1). In one embodiment, colors A and B are different colors selected from a group of colors that include magenta, cyan, yellow, and black. In another embodiment, colors A and B are different colors selected from a group of colors that include dark magenta, light magenta, dark cyan, light cyan, yellow, black, and possibly one or more shades of gray.

Figure 7:
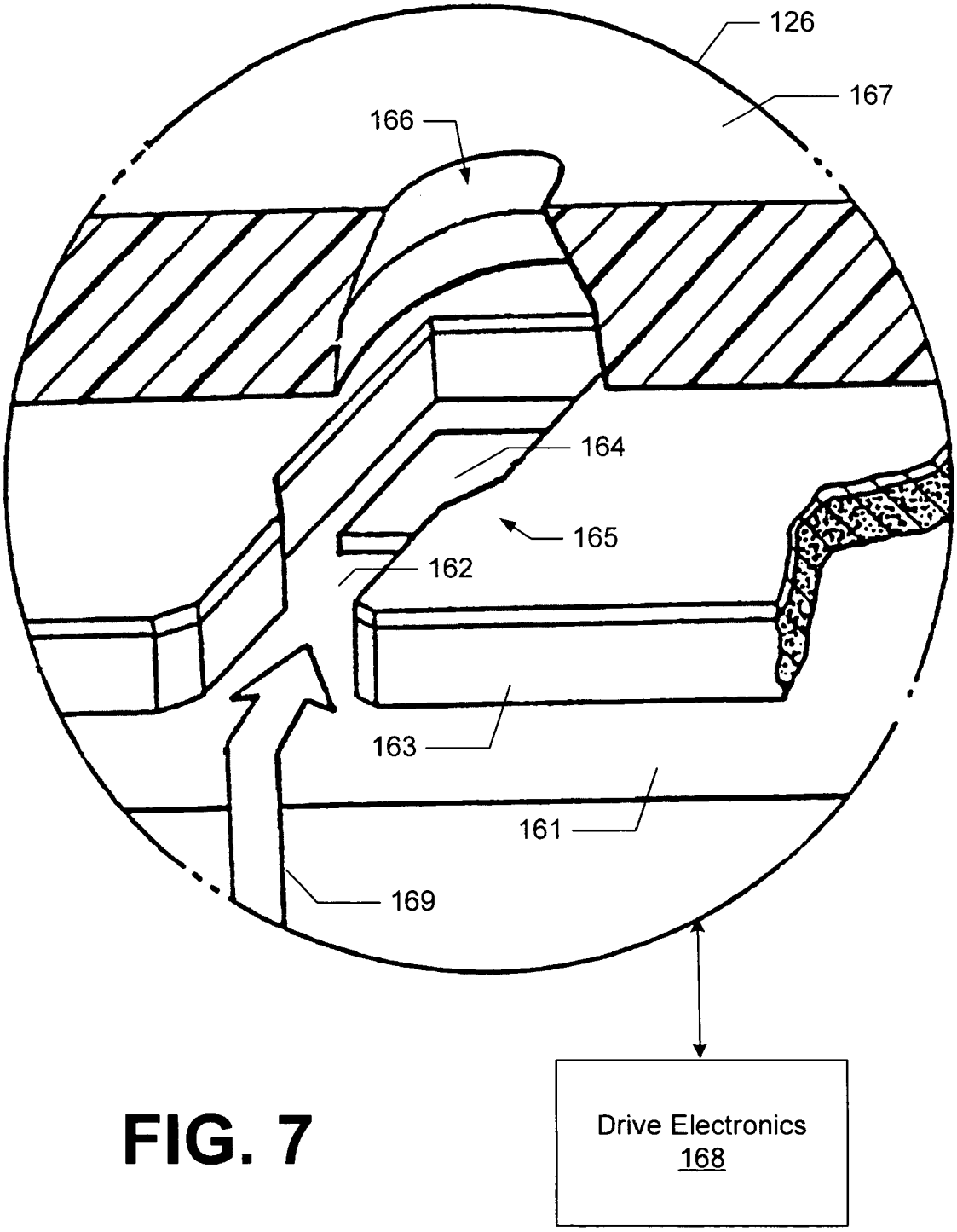
FIG. 7 is a schematic representation according to an embodiment of the present invention of a drop generator usable with the multi-die printhead of FIGS. 6A-6B.

Considering now in greater detail one embodiment of a thermal inkjet drop generator 126, and with reference to FIG. 7, the drop generator 126, as known to those having ordinary skill in the art, is fabricated on a substrate 161. A barrier layer 163 is deposited on the substrate 161 so as to form a chamber 165. A thin film resistor 164 is disposed on the substrate 161 and electrically coupled to drive electronics 168. A nozzle 166 through which drops of the fluid are emitted is formed in a nozzle member 167 attached to the barrier layer 163.

In operation, fluid flows into channel 162 and into chamber 165, as shown by the arrow 169. Upon energization of the thin film resistor 164 by drive electronics 168, a thin layer of the adjacent fluid is superheated, causing explosive vaporization and, consequently, causing a fluid drop to be emitted through the nozzle 166. The chamber 165 is then refilled with fluid by capillary action.

The drive electronics 168 supplies the energy to the firing resistor 164 that causes drop emission. Typically at least one pulse of voltage or current of a particular amplitude and duration is provided to the resistor 164 in order to cause the superheating and vaporization.

The nominal drop weight of the fluid drops emitted from different dies may vary due to manufacturing variations that may occur from die to die. These manufacturing variations may result in geometric changes in the elements of drop generator 126, such as for example the size of firing resistor 164 or nozzle 166, which may consequently affect the nominal drop weights. This leads to the need for the substantial equalization of nominal drop weights among different dies.

In some embodiments, the firing resistors 164 of some or all of the drop generators 126 in a die may be used as the heater for that die. The firing resistors 164 can be operated by the drive electronics 168 at conditions which do not cause drop emission. For example, the energy pulse applied to the resistor 164 may have too low of an amplitude, or too short of a duration, to cause drop emission. However, the pulse causes resistive heating which can warm the die and the fluid disposed in the drop generators 126 of the die. The warmed ink and die can increase the nominal drop weight of the fluid drops emitted from the die. By determining and applying an appropriate amount of pulse warming to individual dies, the nominal drop weights of the dies can be substantially equalized.

Figure 8:
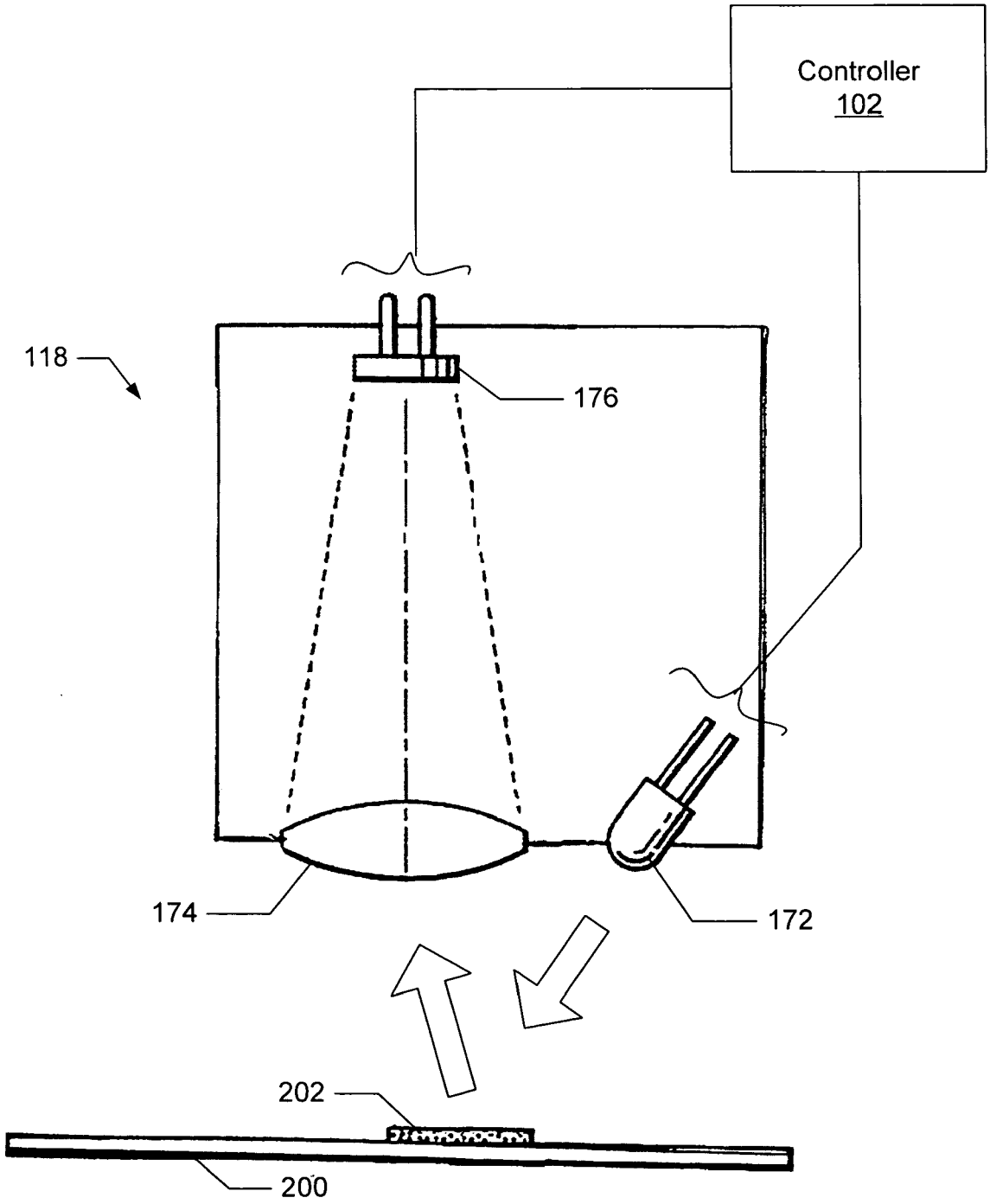
FIG. 8 is a schematic representation according to an embodiment of the present invention of a sensor usable with the printing system of FIG. 4.

Considering now in greater detail the sensor 118, and with reference to FIG. 8, one embodiment of the sensor 118 includes a light source 172, a lens 174, and a detector 176. The sensor 118 may be positionable adjacent to the printed patches 202 on the medium 200; for example, coupled to the transport mechanism 114 or the print mechanism 112. The sensor 118 is capable of measuring an optical characteristic, such as the optical density or the relative darkness, of an individual printed patch and provide the measurement to the controller 102.

The light source 172 may be configured by the controller 102 to illuminate a particular printed patch 202 on the medium 200 with light of a particular color spectrum. In some embodiments, light source 172 may be one or more LEDs. Different ones of the LEDs may produce a different color spectrum of light, such as red, orange, blue, or green. In other embodiments, light source 172 may include one or more filters usable to choose the color spectrum of light emitted. The particular color spectrum may be chosen so as to be complementary to the color of the fluid drops that form the patch 202, in order to improve the performance of the sensor 118 by heightening the darkness or contrast of the patch 202 relative to unprinted areas of the medium 200, thus resulting in an amplified sensor output signal. Incident light having a complementary color spectrum would tend to be mostly absorbed by, rather than reflected from, a patch 202 of a particular color. For example, providing red light for sensing a cyan patch, or blue light for sensing a yellow patch, may heighten the darkness or contrast of the cyan or yellow patch respectively.

The lens 174 gathers light reflected from the patch 202 and focuses the light onto the detector 176. The detector 176 is configured to sense the reflected light from the printed patch 202 and generate a signal representative of the optical density measurement, such as the relative darkness of the patch 202, to the controller 102.

In another embodiment, sensor 118 may be a drop detector configured to directly detect the drop weight or the drop volume of drops emitted onto or adjacent to the sensor 118, rather than indirectly from an optical characteristic of a printed patch 202 formed by the emitted drops on a medium 200. One embodiment of such a sensor 118 is disclosed in the U.S. Pat. No. 6,086,190 to Schantz et al., which is assigned to the assignee of the present invention and hereby incorporated by reference in its entirety.

In yet another embodiment, sensor 118 may be an optical scanner that is adapted to receive and optically scan the medium 200 having the test plot 205 to determine optical characteristics, such as darkness, of the printed patches 202. Such optical scanners as known to those of ordinary skill in the art, and a flatbed or sheet-fed optical scanner mechanism is frequently combined with a printer to form a multifunction printer or "all in one" printing device.

Figure 9:
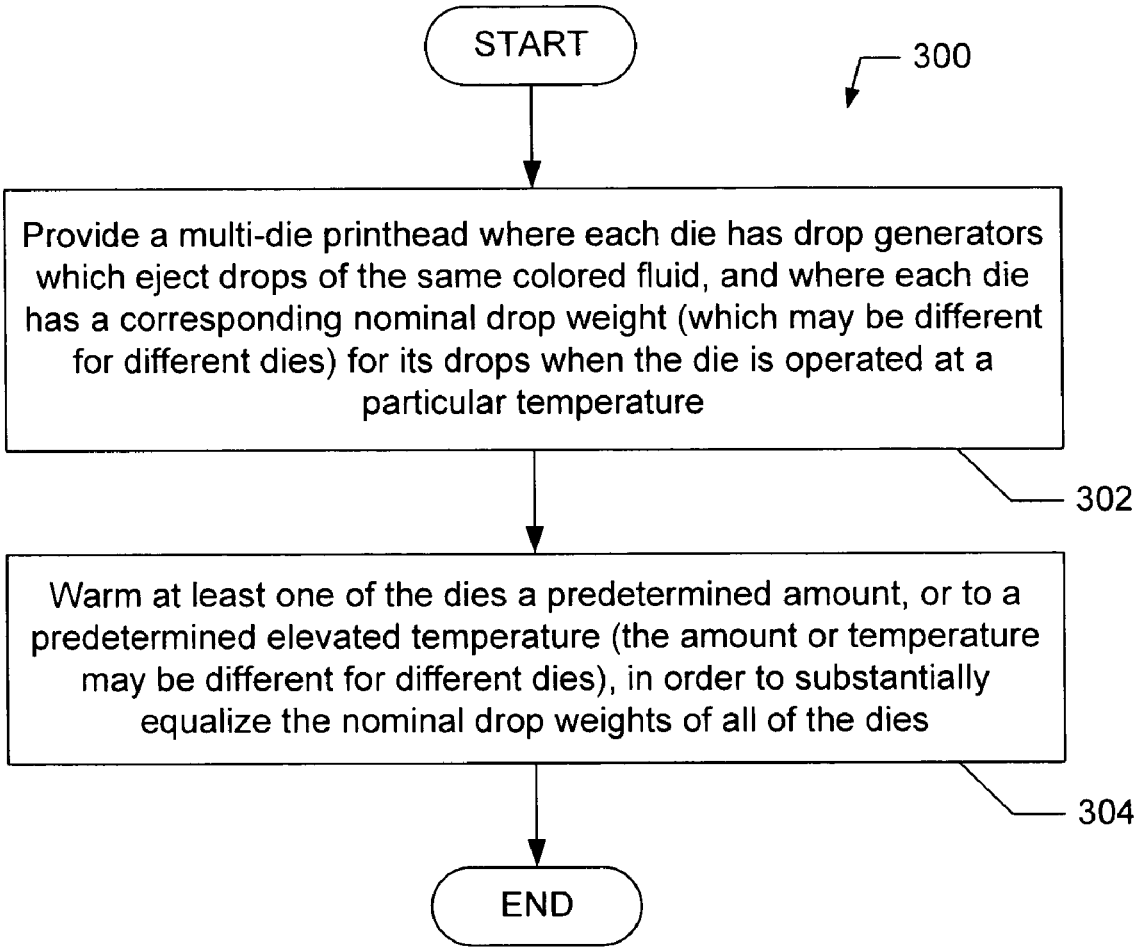
FIG. 9 is a flowchart according to an embodiment of the present invention of a method of printing with a printhead having multiple dies.

Another embodiment of the present invention, as best understood with reference to FIG. 9, is a method 300 for printing with a multi-die printhead 120. At 302, the method 300 provides a multi-die printhead where each die has at least some drop generators 126 which eject drops of the same colored fluid, and where each die has a corresponding nominal drop weight (which may be different for different dies) for its drops, when the die is operated at a particular temperature such as the reference temperature. At 304, at least one of the dies is warmed a predetermined amount, or to a corresponding predetermined elevated temperature higher than the reference temperature, in order to substantially equalize the nominal drop weights of all of the dies. The amount, or the elevated temperature, may be different for different ones of the dies that are warmed.

Figure 10:
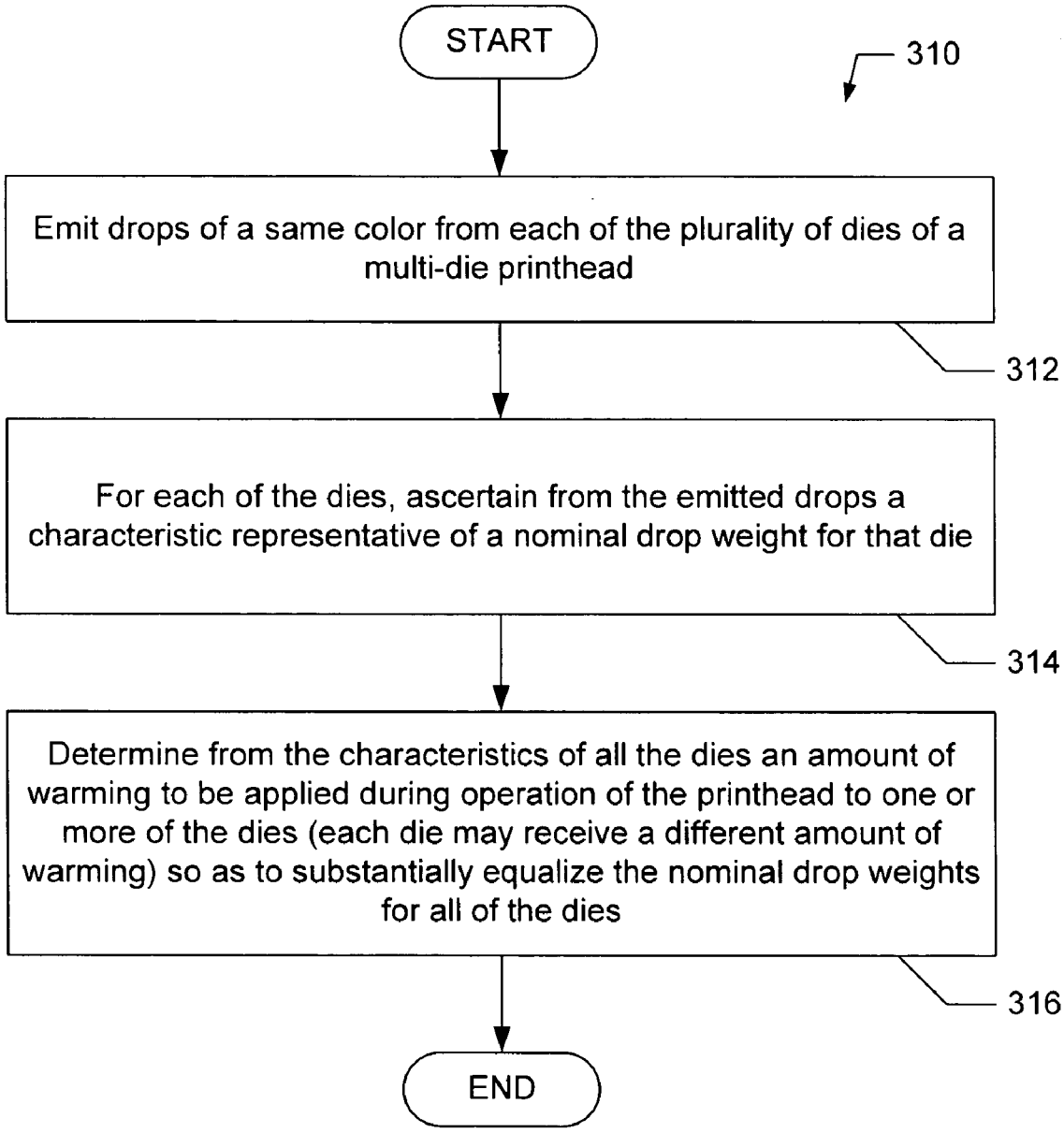
FIG. 10 is a flowchart according to an embodiment of the present invention of a method of calibrating a printhead having multiple dies.

Yet another embodiment of the present invention, as best understood with reference to FIG. 10, is a method 310 for calibrating a printhead 120 having a plurality of dies. At 312, the method 310 emits drops of a same colored fluid from each of the plurality of dies of a multi-die printhead. At 314, a characteristic representative of the nominal drop weight of each die is ascertained from the drops emitted from that die. At 316, an amount of warming to be applied to at least one of the dies during operation of the printhead is determined from the characteristics of all the dies.

The method 310 may be performed whenever a new printhead 120 is installed in the printing system 100, or may be performed periodically such as after a prolonged period of time or usage of the system 100.

Figure 11:
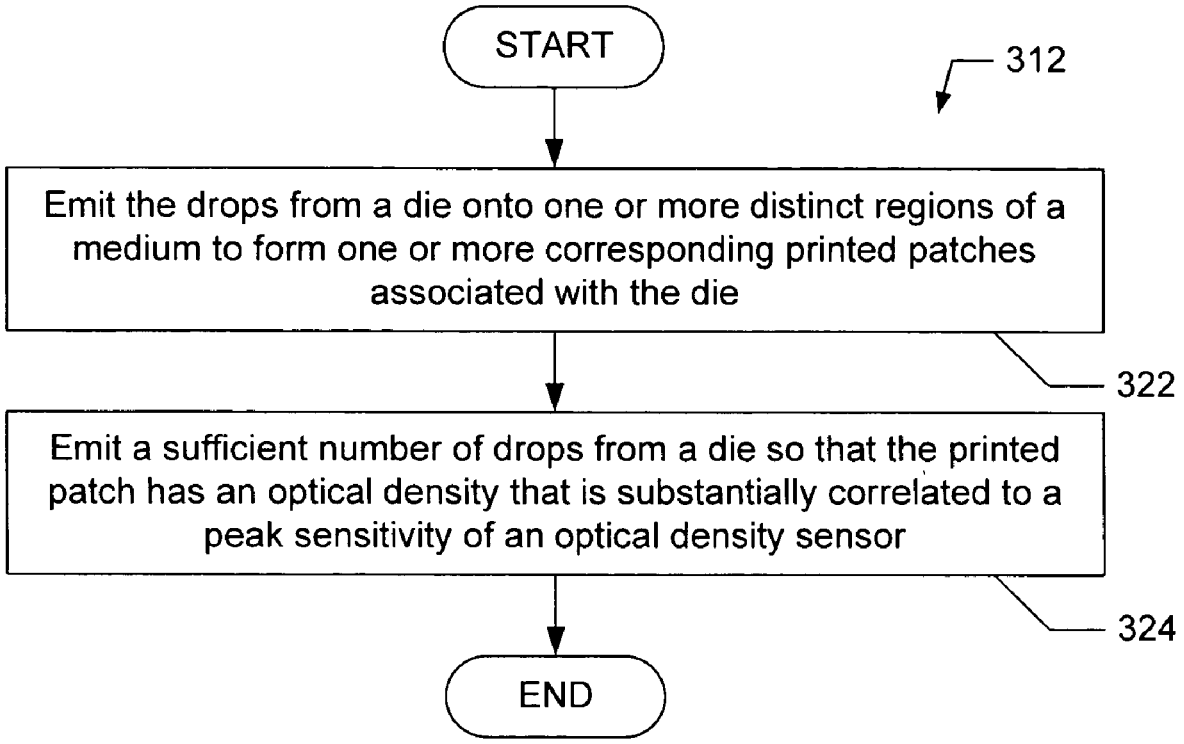
FIG. 11 is a lower-level flowchart according to an embodiment of the present invention of a method of emitting fluid drops usable with the method of FIG. 10.

Considering now in further detail one embodiment of the emitting 312 of the fluid drops, and with reference to FIG. 11, as part of the emitting 312 the drops are emitted at 322 from the die 122 onto one or more distinct regions of a medium 200 to form one or more corresponding printed patches 202 that are associated with the die 122. At 324, a sufficient number of drops are emitted from the die so that the printed patch 202 has an optical density that is substantially correlated to the peak sensitivity of the optical density sensor 118. In this manner, a high quality signal will be provided by the sensor 118 in order to allow the optical density to be ascertained with a high degree of accuracy.

Figure 12:
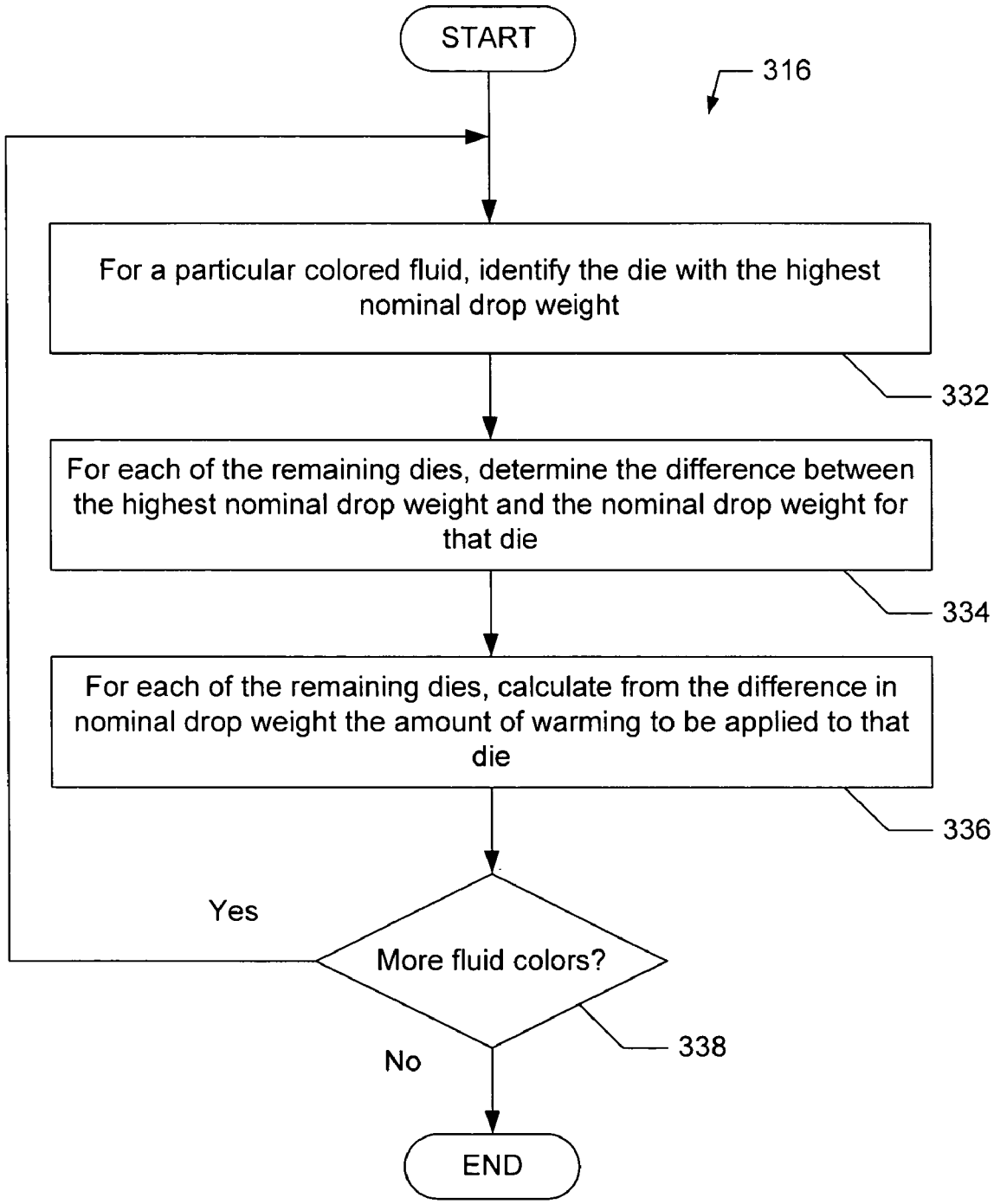
FIG. 12 is a lower-level flowchart according to an embodiment of the present invention of a method of determining amounts of warming to equalize die drop weights usable with the method of FIG. 10.

Considering now in further detail one embodiment of the determining 316 of the amount of warming to be applied during operation of the printhead to one or more of the dies, and with reference to FIG. 12, as part of the determining 316, the die with the highest nominal drop weight for a particular colored fluid is identified at 332. At 334, for each of the remaining dies associated with that particular colored fluid, the difference between the highest nominal drop weight and the nominal drop weight for that die is determined. This difference in nominal drop weights is indicative of the amount of warming that will need to be applied to that die in order to increase its nominal drop weight to be substantially equal to the highest nominal drop weight. At 336, the amounts of warming to be applied to these dies is calculated from the nominal drop weight differences. Once the proper amounts of warming to substantially equalize nominal drop weights have been determined for the dies of one particular color, if there are more fluid colors for which nominal drop weights are to be equalized ("Yes" branch of 338), the determining 316 continues at 332.

From the foregoing it will be appreciated that the printing system and methods provided by the present invention represent a significant advance in the art. Although several specific embodiments of the invention have been described and illustrated, the invention is not limited to the specific methods, forms, or arrangements of parts so described and illustrated.

This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Unless otherwise specified, steps of a method claim need not be performed in the order specified. The invention is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A method for printing with a multi-die printhead, comprising:

providing in the printhead a first die having a plurality of drop generators configured to emit drops of a colored fluid having a predetermined color, the drops having a first nominal drop weight at a reference temperature;

providing in the printhead a second die having a plurality of drop generators configured to emit drops of the colored fluid having the predetermined color, the drops having a second nominal drop weight, different from the first nominal drop weight, at the reference temperature; and warming at least one of the first die and the second die a predetermined amount associated with the respective first or second die so as to substantially equalize the first and second nominal drop weights.

2. The method of claim 1, comprising:

before the warming, determining the predetermined amount for the at least one of the first die and the second die.

3. The method of claim 1, wherein the plurality of drop generators are inkjet drop generators.

4. The method of claim 3. wherein the inkjet drop generators are thermal inkjet drop generators.

5. The method of claim 4, wherein the warming comprises pulse warming the drop generators.

6. The method of claim 4, wherein the warming comprises trickle warming the drop generators.

7. The method of claim 1, wherein the warming includes providing heat from a heat source to the at least one of the first die and the second die.

8. The method of claim 1, wherein the colored fluid is an ink.

9. The method of claim 1, wherein the warming heats the respective die to an elevated temperature higher than the reference temperature.

10. The method of claim 1, wherein the warming heats the respective die to a predetermined change in temperature.

11. The method of claim 1, wherein the first die and the second die cannot emit drops onto a same region of a print media during a single printing pass.

12. The method of claim 11, wherein the media is completely printed by the multi-die printhead in a single printing pass.

13. The method of claim 11, wherein, after the warming, a first region of the media printed with a pattern by one of the dies is substantially visually identical to a second region of the media printed with the pattern.

14. The method of claim 1, comprising:

providing a third die having a plurality of drop generators configured to emit drops of a different colored fluid, the drops having a third nominal drop weight at the reference temperature;

providing a fourth die having a plurality of drop generators configured to emit drops of the different colored fluid, the drops having a fourth nominal drop weight at the reference temperature; and warming at least one of the third die and the fourth die a predetermined amount associated with the respective third or fourth die so as to substantially equalize the third and fourth nominal drop weights.

15. The method of claim 14, wherein the first die and the third die each emit drops onto a region of the media, and wherein the second die and the fourth die each emit drops onto a different region of the media.

16. The method of claim 15, wherein, after the warming, a pattern printed on the region exhibit substantially similar color characteristics as the pattern printed on the different region.

17. The method of claim 16, wherein the color characteristics include at least one of hue, saturation, and lightness.

18. The method of claim 14, wherein the third die and the fourth die are disposed in the multi-die printhead.

19. The method of claim 14, wherein the third die and the fourth die are disposed in a different multi-die printhead.

20. The method of claim 1, wherein the first die further comprises an additional plurality of drop generators configured to emit drops of a different colored fluid, the drops having a third nominal drop weight at the reference temperature.

21. The method of claim 1, wherein the second die further comprises an additional plurality of drop generators configured to emit drops of the different colored fluid, the drops having a fourth nominal drop weight at the reference temperature.

22. The method of claim 1, wherein the warming at least one of the first die and the second die the predetermined amount substantially equalizes the third and fourth nominal drop weights.

23. The method of claim 1, comprising:

determining the predetermined amount from optical density measurements of different regions of printed output produced by the multi-die printhead on a print medium, each of the different regions formed by the colored fluid emitted from only one of the first die and the second die.

24. A method of calibrating a printhead having a plurality of dies, comprising:

emitting drops of a same colored fluid from at least some drop generators of each die onto a distinct region of a medium associated with the die, each distinct region forming a printed patch, wherein each printed patch is formed by the same colored fluid emitted from a different die, and wherein each printed patch has the same intended optical density;

ascertaining an actual optical density of each printed patch, the actual optical density representative of a nominal drop weight of the corresponding die;

determining from the actual optical densities of all the printed patches an amount of warming to be applied to at least one of the dies so as to substantially equalize the nominal drop weights for the plurality of dies.

25. The method of claim 24, comprising:

applying the amount of warming to the at least one of the dies.

26. The method of claim 25, comprising:

after the applying, repeating the emitting and the ascertaining so as to verify that all the printed patches have a substantially equal actual optical density.

27. The method of claim 25, wherein the emitting includes emitting a sufficient number of drops such that the intended optical density of the printed patches is correlated to a peak sensitivity of an optical density sensor.

28. The method of claim 24, wherein the printed patches are clustered in two dimensions so as to collectively occupy a relatively compact area of the medium.

29. The method of claim 24, wherein the printed patches form a first cluster, and wherein the emitting and ascertaining are repeated to form a second cluster printed on a different portion of the medium.

30. The method of claim 29, wherein the determining includes averaging the actual optical densities for the corresponding dies in the first cluster and the second cluster.

31. The method of claim 29, wherein the printed patches in the second cluster are formed by emitting substantially the same number of drops as emitted for the printed patches of the first cluster.

32. The method of claim 29, wherein the printed patches in the second cluster are formed by emitting a different number of drops than were emitted for the printed patches of the first cluster.

33. The method of claim 24, wherein the emitting, the ascertaining, and the determining are performed when the printhead is installed in a printer.

34. A printing system, comprising:

a print mechanism adapted to receive a printhead having a plurality of dies, each die including a plurality of drop generators configured to emit drops of a same colored fluid, the drops from each die having a corresponding nominal drop weight at a reference temperature of the die, the nominal drop weight of at least one of the dies different from the nominal drop weight of at least one other of the dies; and a controller configured to determine from the emitted drops at least one amount of warming, each amount of warming associated with a corresponding one of the dies, needed to substantially equalize the nominal drop weights of all of the dies, the controller further configured to control a heating arrangement disposed in the printhead and thermally coupled to individual ones of the dies so as to apply the at least one amount of warming to the corresponding one of the dies.

35. The system of claim 34, wherein each of the plurality of drop generators is a thermal inkjet drop generator having a firing resistor, wherein the heating arrangement includes the plurality of firing resistors.

36. The system of claim 35, wherein the controller is further configured to apply an energy pulse to selected ones of the firing resistors to produce the at least one amount of warming.

37. The system of claim 36, wherein the energy pulse applied to the selected ones of the firing resistors has at least one of an amplitude or a duration that is insufficient to cause the selected ones of the firing resistors to emit the drops.

38. The system of claim 34, wherein the printhead is a plurality of printheads for emitting drops of the same colored fluid.

39. The system of claim 34, wherein the print mechanism is further adapted to receive an additional printhead having a plurality of additional dies, each additional die including a plurality of additional drop generators configured to emit drops of an additional colored fluid having a different color than the same colored fluid, wherein the heating arrangement is thermally coupled to individual ones of the additional dies, and wherein the controller is further configured to control the heating arrangement so as to apply the at least one amount of warming to the corresponding one of the additional dies.

40. The system of claim 34, wherein the controller is further configured to generate with the print mechanism a test plot on a medium, the test plot including a plurality of printed patches, each printed patch produced by the drops emitted from a corresponding one of the plurality of dies and having an optical density, the optical density representative of the nominal drop weight of the corresponding one of the plurality of dies.

41. The system of claim 40, comprising a sensor in optical communication with the medium, the sensor adapted to measure the optical density of an individual printed patch and provide an optical density measurement to the controller.

42. The system of claim 41, wherein the controller is further configured to obtain from the sensor the optical density measurement associated with each of the plurality of printed patches, and to determine from the optical density measurements the at least one amount of warming.

43. The system of claim 41, wherein the optical density is determined from a relative darkness of the individual printed patch.

44. The system of claim 43, wherein the sensor is an optical scanner adapted to receive the medium having the test plot.

45. The system of claim 43, wherein the sensor includes a light source configured to illuminate the printed patch with light of a particular color, and a detector configured to sense the reflected light from the printed patch and produce a signal representative of the optical density measurement.

46. The system of claim 43, wherein the system is a printer.

47. A printing system, comprising:

means for receiving a printhead having a plurality of dies, each die including a plurality of drop generators configured to emit drops of a same colored fluid, the drops from each die having a corresponding nominal drop weight at a reference temperature of the die, the nominal drop weight of at least one of the dies different from the nominal drop weight of at least one other of the dies; and means for warming each of at least some of the dies to a corresponding elevated temperature higher than the reference temperature so as to substantially equalize the nominal drop weights of all of the dies.

48. The system of claim 47, comprising:

means for ascertaining from the emitted drops a characteristic for each of the dies representative of the nominal drop weight of each of the dies; and means for determining from the characteristics the corresponding elevated temperatures for the at least some of the dies.

49. The system of claim 47, comprising:

means for generating on a medium a test plot having a plurality of printed patches, each printed patch indicative of the nominal drop weight of the corresponding one of the plurality of dies.

50. The system of claim 49, comprising:

means for determining from each of the printed patches the nominal drop weight of the corresponding one of the plurality of dies.

51. A program stored on a computer-readable medium for equalizing drop weights of a plurality of dies in a multi-die printhead, comprising:

code that generates a test plot including a plurality of printed patches having a same intended optical density, each printed patch produced by drops of a same color fluid emitted from a different corresponding one of the plurality of dies, each printed patch having an actual optical density representative of a nominal drop weight of the corresponding one of the plurality of dies;

code that optically analyzes each of the printed patches and determines the actual optical density of each of the printed patches; and code that determines from the actual optical density at least one amount of warming, each amount of warming associated with a corresponding one of the dies, needed to equalize the nominal drop weights of all of the dies.

52. The program of claim 51, comprising:

code that applies each of the at least one amount of warming to the corresponding one of the dies so as to equalize the nominal drop weights of all of the dies.

53. A method for printing, comprising:

providing a plurality of dies, each die having a plurality of drop generators configured to eject drops of a same colored fluid, the drops from each die having a corresponding nominal drop weight at a reference temperature of the die; and warming each of at least one of the dies to a corresponding elevated temperature higher than the reference temperature so as to substantially equalize the nominal drop weights of all of the dies.

54. The method of claim 53, wherein the plurality of dies are disposed in one multi-die printhead, and wherein each of the dies is further incapable of ejecting the drops of the same colored fluid onto a same portion of a print medium during a single printing pass.

55. The method of claim 53, wherein the plurality of dies are disposed in at least two multi-die printheads, and wherein each of the dies is further configured to eject drops of the same colored fluid onto a different portion of a medium.

* * * * *

UNITED STATES PATENT AND TRADEMARK OFFICE

CERTIFICATE OF CORRECTION

PATENT NO. : 7,770,997 B2
APPLICATION NO. : 10/951378
DATED : August 10, 2010
INVENTOR(S) : Wayne Richard et al.

It is certified that error appears in the above-identified patent and that said Letters Patent is hereby corrected as shown below:

In column 13, line 41, in Claim 4, delete "claim 3." and insert -- claim 3, --, therefor.

Signed and Sealed this
Eighth Day of March, 2011

David J. Kappos

David J. Kappos
*Director of the United States Patent and Trademark Office*